US010625136B2

(12) United States Patent
Sites

(10) Patent No.: US 10,625,136 B2
(45) Date of Patent: Apr. 21, 2020

(54) WEIGHTLIFTING CONVERTING DEVICE

(71) Applicant: Jeremy D Sites, Chicago, IL (US)

(72) Inventor: Jeremy D Sites, Chicago, IL (US)

( * ) Notice: Subject to any disclaimer, the term of this patent is extended or adjusted under 35 U.S.C. 154(b) by 105 days.

(21) Appl. No.: 15/993,939

(22) Filed: May 31, 2018

(65) Prior Publication Data

US 2018/0345114 A1 Dec. 6, 2018

Related U.S. Application Data

(60) Provisional application No. 62/515,318, filed on Jun. 5, 2017.

(51) Int. Cl.
*A63B 71/00* (2006.01)
*A63B 21/072* (2006.01)

(52) U.S. Cl.
CPC ..... *A63B 71/0054* (2013.01); *A63B 21/0724* (2013.01); *A63B 2071/009* (2013.01); *A63B 2244/09* (2013.01)

(58) Field of Classification Search
CPC ..... A63B 71/0054; A63B 2244/09; A63B 2071/009
See application file for complete search history.

(56) References Cited

U.S. PATENT DOCUMENTS 3,331,374 A 3/1967 Wittenberg et al.
4,138,804 A 2/1979 Thielen
4,431,185 A 2/1984 Cisneros
4,482,151 A 11/1984 Zwilling
4,503,728 A 3/1985 Fischer et al.
4,639,979 A * 2/1987 Polson ..... A63B 21/0728 24/273
4,913,422 A 4/1990 Elmore et al.
4,971,318 A 11/1990 Tracy
5,102,124 A 4/1992 Diodati
5,221,244 A 6/1993 Doss
5,967,952 A 10/1999 Bronstein et al.
6,132,344 A 10/2000 Vanderbleek
6,224,520 B1 5/2001 Hsu
6,261,211 B1 7/2001 Suarez et al.
6,436,015 B1 8/2002 Frasco et al.
6,602,169 B1 8/2003 Patti
6,682,464 B2 1/2004 Shifferaw
7,458,921 B2 12/2008 Hallar
7,789,813 B2 9/2010 Anderson
8,128,539 B2 3/2012 Dickerson
9,005,008 B2 4/2015 Sides, Jr.
9,039,586 B2 5/2015 Januszek
2005/0075221 A1 4/2005 Fond
2008/0108483 A1 5/2008 Fife
(Continued)

*Primary Examiner* — Loan B Jimenez
*Assistant Examiner* — Thao N Do
(74) *Attorney, Agent, or Firm* — Maxwell J. Petersen; FisherBroyles LLP

(57) ABSTRACT

A weightlifting converting device is provided that includes a plurality of converting segments arranged end-to-end in a chain. Each converting segment has a semi-circular outer surface defining an arc and a planar inner surface. When the weightlifting converting device is installed on a polygonal-shaped weightlifting plate, the planar inner surface of each converting segment engages a flat outer edge of the polygonal plate, and the semi-circular outer surfaces together provide the weightlifting plate with a round outer surface.

20 Claims, 3 Drawing Sheets

(56) References Cited

U.S. PATENT DOCUMENTS

| | | | | |
|---|---|---|---|---|
| 2008/0200315 | A1 | 8/2008 | Lin | |
| 2008/0214368 | A1 | 9/2008 | Cao | |
| 2008/0248931 | A1 | 10/2008 | Hoole | |
| 2009/0069045 | A1* | 3/2009 | Cheng | H02J 7/0042 455/556.1 |
| 2010/0022359 | A1 | 1/2010 | Lin | |
| 2014/0243168 | A1 | 8/2014 | Razzaq | |
| 2014/0256520 | A1 | 9/2014 | Davies, III | |
| 2017/0080274 | A1 | 3/2017 | Dickerson | |
| 2017/0095687 | A1 | 4/2017 | Sonnon et al. | |
| 2017/0304671 | A1* | 10/2017 | Hill | A63B 21/0603 |
| 2018/0028857 | A1* | 2/2018 | Rothschild | A63B 71/0054 |

* cited by examiner

WEIGHTLIFTING CONVERTING DEVICE

RELATED APPLICATION

This patent application claims priority to U.S. Provisional Application Ser. No. 62/515,318, filed on Jun. 5, 2017, the disclosure of which is incorporated by reference.

FIELD OF THE INVENTION

This invention is directed to a weightlifting converting device that provides a rounded outer edge to polygonal-shaped weightlifting plates.

BACKGROUND OF THE INVENTION

In recent years, polygonal-shaped weightlifting plates having six, eight or twelve flat outer edges have grown in popularity, and have increasingly replaced traditional weightlifting plates having circular edges. The increasingly predominant use of polygonal weightlifting plates has presented challenges when the weightlifting plates are used for deadlifts, clean and press, clean and jerk, snatches, rowing, and other exercises in which the barbell loaded with the plates is picked up and returned to the floor of the gym. When the barbell is in motion above the floor, the weightlifting plates often rotate due to the bending and other forces transmitted from the barbell to the plates. The plates on the left side of the barbell may rotate by a different amount and/or in a different direction than the plates on the right side of the barbell. When multiple plates are loaded on either side of the barbell, the plates on either side of the bar may rotate by different amounts. As a result, when the loaded barbell is returned to the floor during an exercise, the polygonal-shaped plates are offset relative to each other, causing the loaded barbell to displace toward the user's legs or away from the user, on one or both sides.

The seemingly random displacement of the loaded barbell when it touches the floor is inconvenient at best and injurious at worst. Such repeated displacement can cause scrapes and bruises to the user's legs, back sprains, shoulder sprains, and loss of coordination and balance during repetitions. There is a need and desire for a device which alleviates these problems and is convenient to use and carry.

SUMMARY OF THE INVENTION

The present invention is directed to a weightlifting converting device that provides a rounded outer edge to a polygonal weightlifting plate. The weightlifting converting device includes a plurality of converting segments linked together in a chain, each designed to convert one flat outer edge of a polygonal weightlifting plate to a rounded outer surface. Each converting segment includes:

- a semi-circular outer surface, a planar inner surface, a first side, a second side, a first end and a second end;
- first and second sleeve members extending inward from the first and second sides, respectively, and beyond the planar inner surface; and
- hinge elements located at the first and second ends, respectively, for attaching the converting segment to an adjacent converting segment.

The number of converting segments linked together in the converting device should equal the number of flat outer edges on the polygonal weightlifting plate. For example, the converting device may include at least three converting segments and may include four converting segments for a square weightlifting plate, six converting segments for a hexagonal weightlifting plate, eight converting segments for an octagonal weightlifting plate, ten converting segments for a decagonal weightlifting plate, or twelve converting segments for a dodecagonal weightlifting plate.

Each semi-circular outer surface should have an arc, measured in degrees, that is about equal to 360 divided by the number of converting segments in the weightlifting bumper assembly. In other words, the sum total of all the arcs in the weightlifting converting device should approach 360 degrees, which is a full circle, enabling the converting device to cover the full perimeter of the polygonal weightlifting plate. The semi-circular outer surface may be semi-cylindrical.

The present invention is also directed to a combination that includes a polygonal weightlifting plate and a weightlifting converting device as described above. The polygonal weightlifting plate includes at least three flat outer edges and may include four, six, eight, ten, twelve, or another number of outer edges. The weightlifting converting device includes a plurality of converting segments equal to the number of flat outer edges on the weightlifting plate. Again, each converting segment includes:

- a semi-circular outer surface, a planar inner surface, a first side, a second side, a first end and a second end;
- first and second sleeve members extending inward from the first and second sides, respectively and beyond the planar inner surface; and
- hinge elements located at the first and second ends, respectively, attaching the converting segment to an adjacent converting segment.

The converting segments are attached together end-to-end using the hinge elements and are positioned to envelop the flat outer edges of the polygonal weightlifting plate, with the sleeve members extending slightly inward over the two opposing sides of the weightlifting plate. The weightlifting converting device thereby provides a rounded outer edge to the polygonal weightlifting plate. When multiple weightlifting plates are positioned on a barbell, it is only necessary to fit two of the weightlifting plates (one on each side of the barbell) with the weightlifting converting device. The weightlifting converting device slightly increases the outer diameter of each weightlifting plate (one on each side), so that the flat edges and corners of the remaining (uncovered) polygonal weightlifting plates never touch the ground.

With the foregoing in mind, it is a feature and advantage of the invention to provide a weightlifting converting device that provides a polygonal weightlifting plate with a rounded outer edge and a slightly increased diameter.

It is also a feature and advantage of the invention to provide a combination that includes a polygonal weightlifting plate and the foregoing weightlifting converting device. The weightlifting converting device and combination alleviate the existing challenges and potential injuries that result from using polygonal weightlifting plates in exercises where the loaded barbell is lifted from and returned to the ground.

The foregoing and other features and advantages will become further apparent from the following Detailed Description of the Invention, read in conjunction with the drawings.

DETAILED DESCRIPTION OF THE INVENTION

Figure 1:
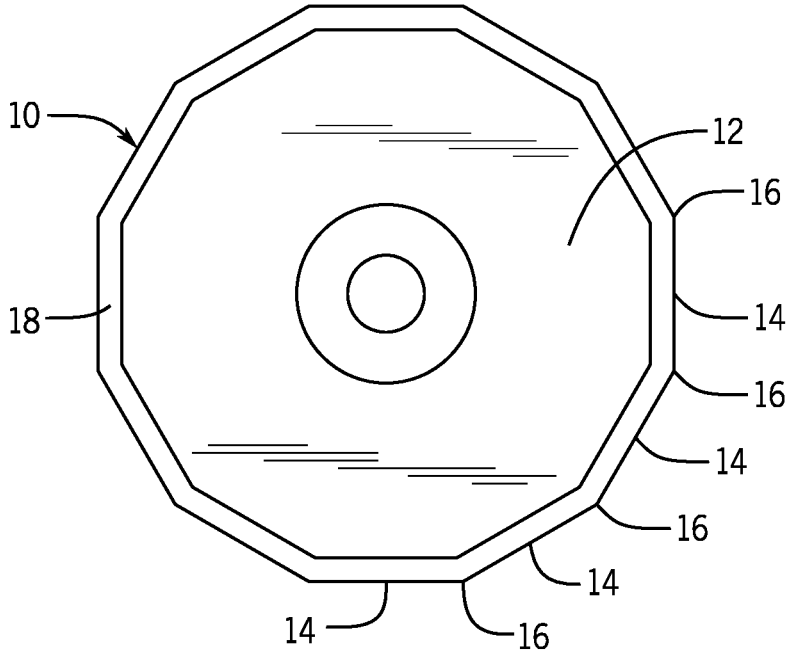
FIG. 1 is a front view of one typical polygonal weightlifting plate, in this case a dodecagonal plate which can weigh 45 lbs. or some other weight.

Referring to FIG. 1, a conventional polygonal weightlifting plate 10 includes a front surface 12, a back surface (not shown), and a plurality of flat outer edges 14 that intersect at corners 16. The polygonal weightlifting plate has at least three flat outer edges, and may include four, five, six, seven, eight, nine, ten, eleven, twelve, or a larger number of flat outer edges 14 intersecting at corners 16. FIG. 1 illustrates an exemplary dodecagonal weightlifting plate having twelve flat outer edges 14 intersecting at corners 16. The outer edges 14 may form part of a rim 18 which, as shown in FIG. 1, may have a thickness slightly greater than the overall thickness of the weightlifting plate 10.

Figure 2:
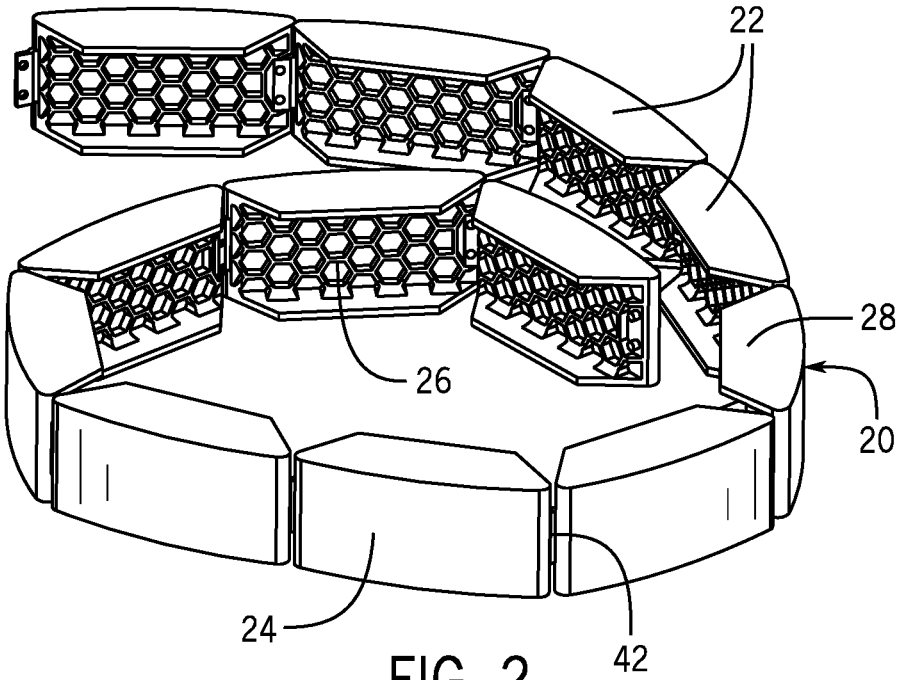
FIG. 2 is a perspective view of a weightlifting converting device of the invention.
Figure 3:
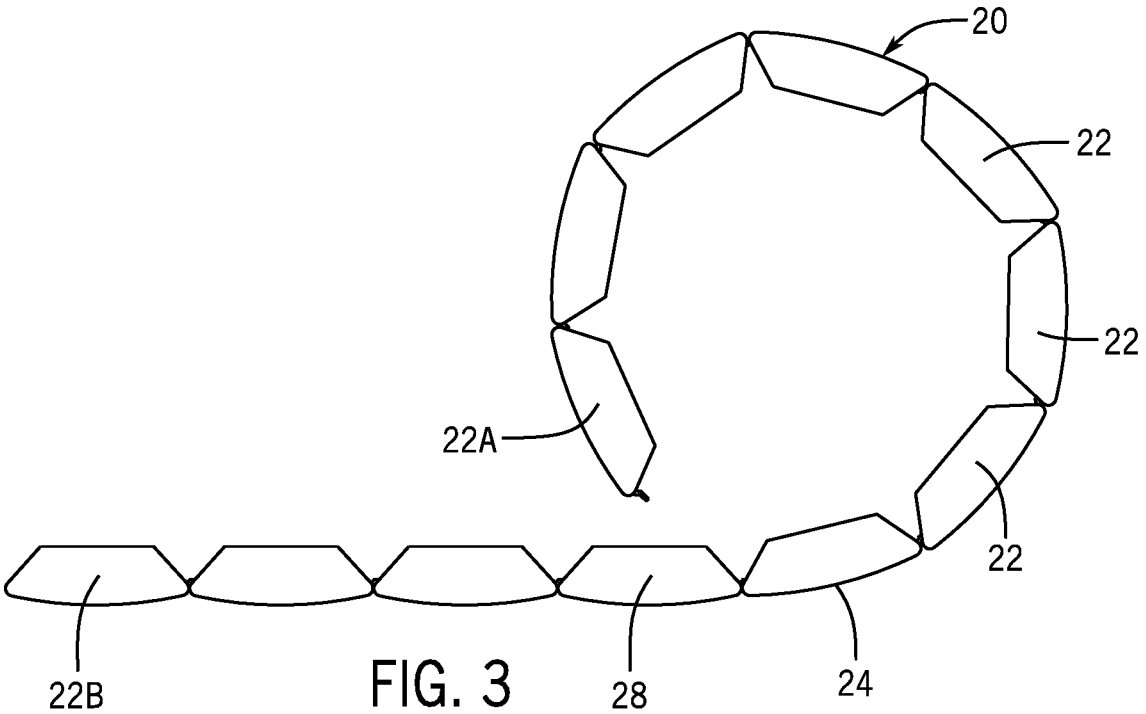
FIG. 3 is a front view of the weightlifting converting device of FIG. 2.

Referring to FIGS. 2 and 3, the weightlifting converting device 20 includes a plurality of converting segments 22 that are equal in number to the number of flat edges 14 on the weightlifting plate 10 to be covered. The weightlifting converting device 20 includes at least five of the converting segments 22 and may include six, seven, eight, nine, ten, eleven, twelve or more of the converting segments 22. Each converting segment 22 has a length that is about equal to the length of one of the flat edges 14 to be covered. As further illustrated in FIGS. 5-8, each converting segment 22 has a semi-circular outer surface 24 which can be semi-cylindrical, a planar inner surface 26, a first side 28, a second side 30, a first end 32 and a second end 34.

Figure 4:
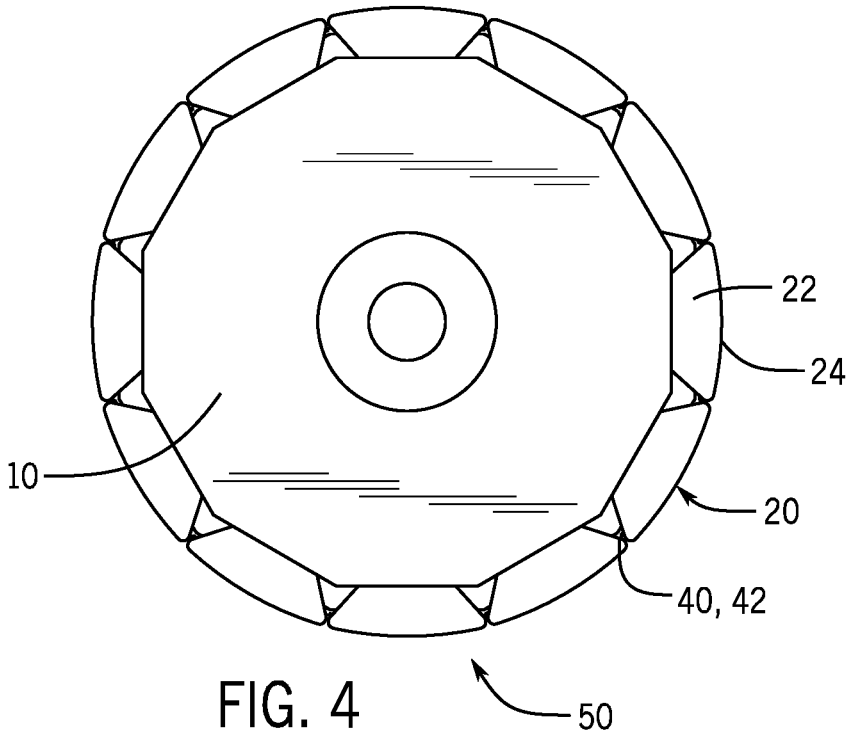
FIG. 4 is a front view of a combination of the invention, including the polygonal weightlifting plate of FIG. 1 wrapped with the weightlifting converting device of FIG. 2.
Figure 7:
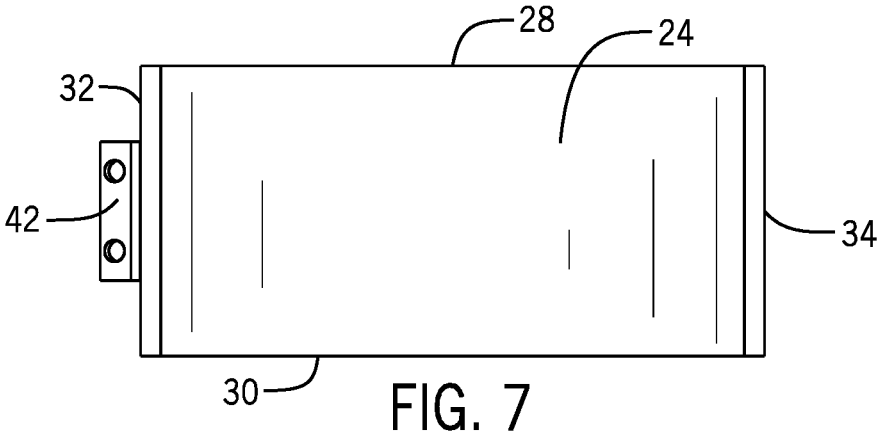
FIG. 7 is a top view of the converting segment of FIG. 5.
Figure 8:
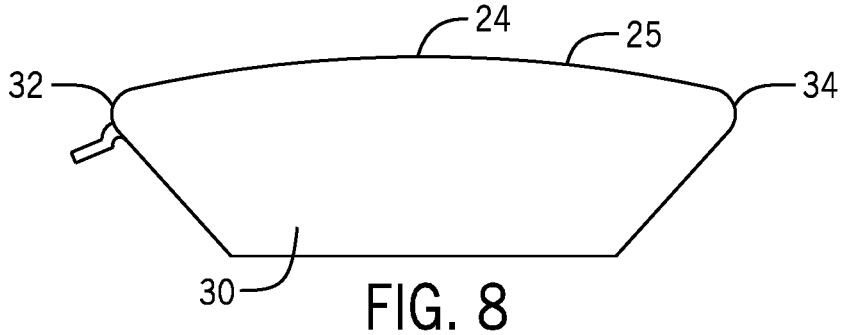
FIG. 8 is a front view of the converting segment of FIG. 5.

The semi-circular outer surface 24 of each converting segment 22 has an arc 25 which, when measured in degrees, is approximately equal to 360 divided by the number of converting segments 22 in the weightlifting converting device 20. For example, the illustrated converting assembly 20 has twelve converting segments 22. In this embodiment, the arc 25 on the semi-circular outer surface 24 of each converting segment is about 30 degrees. Thus, as shown in FIG. 4, when the weightlifting converting device 20 is mounted on the plate 10, the sum total of the twelve arcs 25 spans the entire 360-degree circumference of a circle. In a presently preferred embodiment, the outer surface 24 of each converting segment 22 is both semi-circular and semi-cylindrical. Thus, as shown in FIGS. 2, 7 and 8, the outer surface 24 is substantially linear perpendicular to the arc 25, as would occur in a semi-cylinder.

Figure 5:
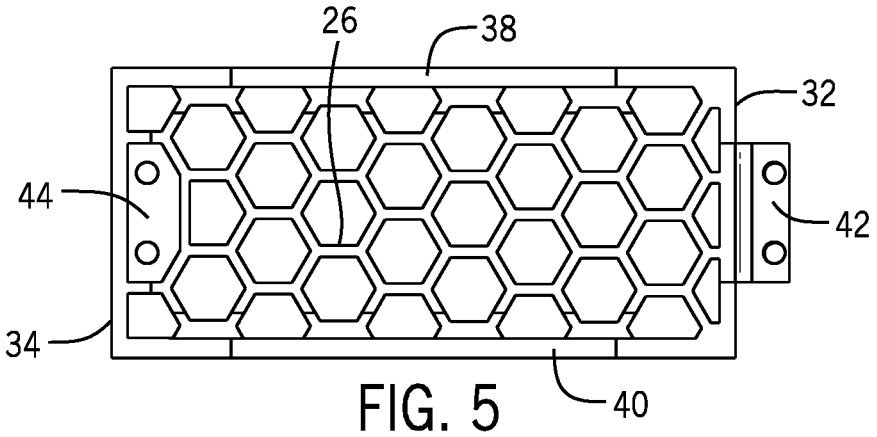
FIG. 5 is a bottom view of a single converting segment of the weightlifting converting device.
Figure 6:
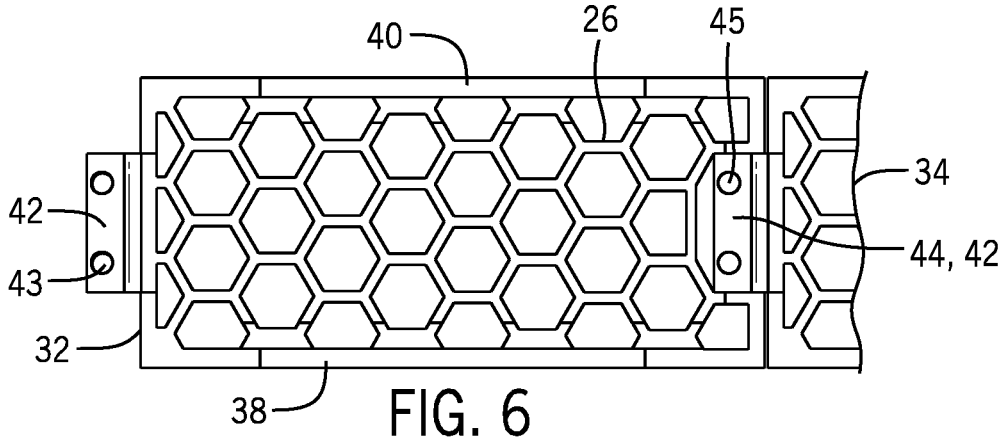
FIG. 6 is a bottom view of the converting segment of FIG. 5, showing the attachment to an adjacent converting segment.

The planar inner surface 26 is a substantially flat surface of converting segment 22 that makes direct contact with the corresponding flat edge 14 on the weightlifting plate 10. As shown in FIGS. 2, 5, and 6, the planar inner surface 26 need not be continuous, but can have pockets or other discontinuities formed therein, as long as the inner surface 26 is essentially flat and planar. The illustrated honey comb-shaped inner surface 26 saves on material cost and weight.

As best illustrated in FIGS. 2, 5 and 6, a first sleeve member 38 extends inward from the first side 28 of each converting segment 22 and beyond the planar inner surface 26. A second sleeve member 40 extends inward from the second side 30 of each converting segment 22 and beyond the planar inner surface 26. As shown in FIG. 4, when the converting device 20 is installed on the weightlifting plate 10, the sleeve members 38 and 40 envelope the outer edges 14 and rim 18 and maintain the converting device 20 in position.

Referring to FIGS. 2, 5, 6 and 7, exemplary hinge elements 42 and 44 are located, respectively, at the ends 32 and 34 of each converting segment 22. The purpose of the hinge elements is to join the adjacent converting segments 22 end-to-end to form the converting device 20. In the illustrated embodiment, the protruding male hinge element 44 mates with the female hinge element 44 to enable a snap-in attachment of adjacent converting segments 22. Any suitable hinge elements can work, providing that at least one of the hinge elements (42 or 44) is configured to allow some pivoting of the converting segments 22 relative to each other. In the embodiment shown, female hinge element 42 has fastener openings 43 and pivots around a dowel pin located at its base. Hinge element 44 is a non-pivoting male hinge element having fastener protrusions 45. As shown in FIG. 6, the female openings 43 on the pivoting hinge element 42 receive the male protrusions 45 on the hinge element 44 to enable the joining (e.g., snapping) of two adjacent converting segments 22 together. This joining (e.g. snapping) of converting segments 22 together can be repeated for all of the segments 22 to form the weightlifting converting derive 20 shown in FIGS. 2 and 3, which can be left open (unhinged) at just one location when not in use.

The converting device 20 can be carried around in a gym bag or other suitable container in the assembled state shown in FIGS. 2 and 3, and the multiple converting segments 22 need not be repeatedly assembled and disassembled. In one alternative embodiment, the multiple converting segments 22 may be permanently hinged together by permanent hinge elements so as to leave only one location in the converting device where the converting segments 22 can be fastened and unfastened during and after use. This embodiment reduces the likelihood of converting segments 22 being separated from each other during use of the converting device 20. In another embodiment, the converting device 20 can be manufactured as a continuous unitary device with the segments 22 permanently joined. In this embodiment, the hinge elements may be formed as a bridging piece of flexible material that enables some bending, but no separation between the converting segments 22. The invention is not limited to any particular type of hinging between adjacent converting segments 22, but is intended to cover any suitable hinging arrangement that provides sufficient attachment and pivoting between the converting segments.

Referring to FIGS. 3 and 4, the converting device 30 can be installed on a polygonal weightlifting plate 10 by wrapping the converting device 20 around the outer edges 14 and rim 18 of the polygonal plate 10 and fastening the end converting segments 22A and 22B together. The combination 50 thus formed includes the polygonal weightlifting plate 10 and the converting device 20. The converting device 20 is positioned on the polygonal plate 10 so that each individual converting segment 22 covers a corresponding flat outer edge 14 of the plate 10, and the hinged juncture (42 and/or 44) between the adjacent converting elements 22 is positioned over the corners 16 of the weightlifting plate 10.

Because the converting segments 22 have curved outer surfaces 24 whose arcs add up to 360 degrees, the converting device 20 provides the combination 50 with a circular, preferably cylindrical outer edge that overcomes the flat edges 14 and corners 16 on the polygonal weightlifting plate 10. Moreover, only two of the polygonal plates 10 (one on each side of the barbell) need to be combined with a converter device 20 in order to overcome the disadvantages that result from the polygonal plates 10 being lowered and raised from the floor during exercise. This is because the converter assemblies 20 add slightly to the diameters of the polygonal plates 10 (FIG. 1) on each side of the barbell, so that only the combinations 50 of plates 10 and converting devices 20 (FIG. 4) touch the floor of the gym during exercise.

By way of example, a 45-lb polygonal weightlifting plate is often the largest plate available for the barbell. When performing a heavy exercise such as the deadlift, the user may stack three or more of these plates on both sides of the barbell. A standard 45-lb dodecagonal plate may have a side-to-side distance of 17 inches and a corner to corner distance of 17.5 inches. By designing the converting device 20 to provide a combination 50 having a diameter of 18.5 inches, only the combination 50 (applied to each side of the barbell) will touch the floor during exercise. Regardless of how many additional 45-lb dodecagonal plates 10 are placed on each side of the barbell, the remaining plates 10 will never touch the floor during exercise. By having only two of the combinations 50 (one on each side) touch the floor, the remaining plates 10 will also between much easier to load and remove from the barbell.

The converting segments 22 used to make the converting device 20 can be molded or otherwise formed from any suitable thermoplastic or thermoset polymer material having sufficient durability to withstand the repeated collision of heavily loaded barbells with the gym floor. The material may have a Shore A hardness of about 70 to about 100, suitably about 80 to about 90, measured using ASTM D12240. Suitable polymer materials include without limitation Innothane® IE-90A, which is a tough semi-flexible polyurethane elastomer available from Innovative Polymers, Inc. in St. Johns, Mich. This material has a Shore A hardness of 85±5 measured using ASTM D-2240, a tensile strength of 1750 psi measured using ASTM D-638, an elongation at break of 180% measured using ASTM D-638, a tensile strength of 215 pli measured using ASTM D-624, and a linear shrink of less than 0.005 in./in., measured using ASTM D-2566. Other suitable polymer materials, and combinations thereof, may also be used.

While the embodiments of the invention described herein are presently preferred, various modifications and improvements can be made without departing from the spirit and scope of the invention.

I claim:

1. A weightlifting converting device comprising a plurality of converting segments arranged in a chain, wherein each converting segment includes:

a semi-circular outer surface defining a continuous arc, a planar inner surface opposite the semi-circular outer surface, a first side, a second side, a first end and a second end;

first and second sleeve members extending inward from the first and second sides, respectively, and beyond the planar inner surface; and hinge elements located at the first and second ends, respectively for attaching the converting segment to an adjacent converting segment;

wherein the continuous arcs defined by the semi-circular outer surfaces, measured in degrees, add up to about 360 degrees.

2. The weightlifting converting device of claim 1, comprising three or more of the converting segments arranged in the chain.

3. The weightlifting converting device of claim 1, comprising eight or more of the converting segments arranged in the chain.

4. The weightlifting converting device of claim 1, wherein the continuous arc defined by each semi-circular outer surface, measured in degrees, is about 360 divided by the number of converting segments in the chain.

5. The weightlifting converting device of claim 1, wherein each semi-circular outer surface is semi-cylindrical.

6. The weightlifting converting device of claim 1, wherein each planar inner surface has pockets formed therein.

7. The weightlifting converting device of claim 1, wherein the hinge elements comprise a female hinge element at the first end of each converting segment and a male hinge element at the second end of each converting segment.

8. The weightlifting converting device of claim 1, wherein at least some of the converting segments in the chain are permanently hinged together.

9. The weightlifting converting device of claim 8, wherein the converting segments arranged in the chain are formed as a continuous unitary device.

10. The weightlifting converting device of claim 9, wherein the hinge elements between converting segments are formed as a bridging piece of flexible material.

11. A weightlifting converting device comprising twelve converting segments arranged in a chain, wherein each converting segment includes:

a semi-circular outer surface defining a continuous arc, a planar inner surface opposite the semi-circular outer surface, a first side, a second side, a first end and a second end;

first and second sleeve members extending inward from the first and second sides, respectively, and beyond the planar inner surface; and hinge elements for attaching each converting segment to an adjacent converting segment;

wherein the continuous arcs defined by the semicircular outer surfaces, measured in degrees, add up to about 360 degrees.

12. The weightlifting converting device of claim 11, wherein the hinge elements include a pivoting mechanism and a fastening mechanism.

13. The weightlifting converting device of claim 11, wherein at least some of the converting segments in the chain are permanently connected together.

14. A combination, including a polygonal weightlifting plate having three or more flat outer edges and corners between the flat outer edges, and a weightlifting converting device;

the weightlifting converting device including a plurality of converting segments equal in number to the plurality of flat outer edges, each converting segment covering one of the flat outer edges;

each converting segment including a semi-circular outer surface defining a continuous arc, and a planar inner surface opposite the semi-circular outer surface that engages a flat outer edge of the polygonal weightlifting plate;

wherein the converting segments are arranged in a chain such that the continuous arcs defined by the semi-circular outer surfaces add up to about 360 degrees and together define a circular outer surface of the combination.

15. The combination of claim 14, wherein the semi-circular outer surface of each converting segment is semi-cylindrical.

16. The combination of claim 14, wherein the polygonal weightlifting plate has at least six of the flat edges and the weightlifting converting device has an equal number of the converting segments.

17. The combination of claim 14, wherein the polygonal weightlifting plate comprises twelve of the flat edges, the weightlifting converting device comprises twelve of the converting segments, and the continuous arc defined by each semi-circular outer surface is about 30 degrees.

18. The combination of claim 14, wherein each of the converting segments further comprises first and second members that extend inward from the planar inner surface and over a rim of the polygonal weightlifting plate.

19. The combination of claim 14, wherein the converting segments comprise a material having a Shore A hardness of about 70 to about 100.

20. The combination of claim 19, wherein the Shore A hardness of the material is about 80 to 90.

* * * * *